US008240104B2

(12) United States Patent
Koikas et al.

(10) Patent No.: US 8,240,104 B2
(45) Date of Patent: Aug. 14, 2012

(54) BUILDING STRUCTURES AND COMPONENTS THEREFOR

(76) Inventors: Nick Koikas, Bexley (AU); Cleo Koikas, Bexley (AU)

( * ) Notice: Subject to any disclaimer, the term of this patent is extended or adjusted under 35 U.S.C. 154(b) by 0 days.

(21) Appl. No.: 12/676,616

(22) PCT Filed: Sep. 11, 2007

(86) PCT No.: PCT/AU2007/001341

§ 371 (c)(1),
(2), (4) Date: Mar. 5, 2010

(87) PCT Pub. No.: WO2009/033201

PCT Pub. Date: Mar. 19, 2009

(65) Prior Publication Data

US 2011/0107702 A1 May 12, 2011

(51) Int. Cl.
*E04B 2/00* (2006.01)

(52) U.S. Cl. ..... 52/585.1; 52/586.1; 52/582.1; 52/479

(58) Field of Classification Search ..... 52/479, 52/481.2, 483.1, 578, 582.1, 586.1, 586.2, 52/585.1, 426, 428
See application file for complete search history.

(56) References Cited

U.S. PATENT DOCUMENTS

| | | | | |
|---|---|---|---|---|
| 510,720 | A | 12/1893 | Stewart, Jr. | |
| 3,460,304 | A | 8/1969 | Braeuninger et al. | |
| 3,570,205 | A * | 3/1971 | Payne | 52/466 |
| 3,609,933 | A * | 10/1971 | Jahn | 52/461 |
| 3,623,290 | A * | 11/1971 | Downing | 52/481.2 |
| 4,020,611 | A * | 5/1977 | Amos | 52/586.1 |
| 4,332,119 | A * | 6/1982 | Toews | 52/481.2 |
| 4,557,091 | A | 12/1985 | Auer | |
| 4,635,422 | A * | 1/1987 | Nowack et al. | 52/406.1 |
| 4,922,678 | A | 5/1990 | Scheiwiller | |
| 5,465,542 | A | 11/1995 | Terry | |
| 5,625,989 | A * | 5/1997 | Brubaker et al. | 52/309.12 |

(Continued)

FOREIGN PATENT DOCUMENTS

| | | |
|---|---|---|
| CN | 2218213 Y | 1/1996 |
| CN | 2558707 Y | 7/2003 |
| JP | 58-199956 A | 11/1983 |

(Continued)

OTHER PUBLICATIONS

International Search Report for PCT/AU2007/001341 mailed Nov. 1, 2007.

*Primary Examiner* — Brian Glessner
*Assistant Examiner* — Brian D Mattei
(74) *Attorney, Agent, or Firm* — Smith, Gambrell & Russell, LLP

(57) ABSTRACT

A building component for a structure, the building component including a component body which includes two spaced apart and generally parallel interconnected side walls having opposed ends and opposed longitudinally extending sides, the building component being adapted to join with a second building component or to a connector for joining the building component to the second building component, the building component further including a plurality of coupling elements arranged at spaced-apart intervals along a length of the sidewalls from one of the longitudinal sides to the other and arranged such that in use the side walls can be cut or otherwise separated along the length thereof so as to provide a coupling element at the cut or separated end which is adapted to cooperate with a coupling element on said connector for securement of the component to the second building component or connector.

19 Claims, 12 Drawing Sheets

U.S. PATENT DOCUMENTS

| | | | | |
|---|---|---|---|---|
| 5,644,878 | A * | 7/1997 | Wehrmann | 52/287.1 |
| 5,860,262 | A * | 1/1999 | Johnson | 52/426 |
| 6,647,686 | B2 * | 11/2003 | Dunn et al. | 52/426 |
| 6,658,808 | B1 * | 12/2003 | Doherty et al. | 52/580 |
| 7,882,672 | B2 * | 2/2011 | Emblin | 52/426 |

FOREIGN PATENT DOCUMENTS

| | | | |
|---|---|---|---|
| JP | 7-224436 | A | 8/1995 |
| JP | H09-505857 | A | 6/1997 |
| TW | 200108 | | 2/1993 |
| WO | 94/28262 | A2 | 12/1994 |

* cited by examiner

BUILDING STRUCTURES AND COMPONENTS THEREFOR

FIELD OF THE INVENTION

This invention relates generally to building structures and more particularly to components and assemblies for use in such structures.

One particular application concerns components and assemblies which are adapted to be used in the formation of building walls. It will be convenient to hereinafter describe the invention with reference to this particular application however it is to be understood that the scope of the invention is not to be limited to that particular application. It will be apparent to the skilled addressee that the invention may find use in other applications.

BACKGROUND TO THE INVENTION

It is known to construct building walls using hollow elements which can be secured together and the hollow space filled with concrete to produce a rigid structure. One problem associated with such structures is their lack of versatility.

It is an object of the present invention to provide building components and assemblies which alleviate one or more of the aforementioned disadvantages.

SUMMARY OF THE INVENTION

According to one aspect of the present invention there is provided a building component for a structure, the building component including a component body which includes two spaced apart and generally parallel interconnected side walls having opposed ends and opposed longitudinally extending sides, the building component being adapted to join with a second building component or to a connector for joining the building component to the second building component, the building component further including a plurality of coupling elements arranged at spaced-apart intervals along a length of the sidewalls from one of the longitudinal sides to the other and arranged such that in use the side walls can be cut or otherwise separated along the length thereof so as to provide a coupling element at the cut or separated end which is adapted to cooperate with a coupling element on said connector for securement of the component to the second building component or connector.

Preferably the building component and connector have cooperating coupling elements mounted thereon which provide for a snap fit engagement between the connector and the component.

The coupling element associated with the coupling body may extend longitudinally along that longitudinal side from one of the ends to the other.

The cooperating coupling elements may include a cavity on one part and a tongue on the other part, the tongue being receivable within the cavity in a snap fit engagement. In one form the cavity is in the form of a channel which extends along the longitudinal side edge of the component between the opposed ends. The cavity may include a mouth opening into the cavity interior and a throat section through which the tongue passes in a snap fit fashion.

The building component may further include at least one cross-member extending between the side walls. In one form the or each cross-member is in the form of a transverse wall which is secured to or integral with an inner surface of each side wall. In one form the or each cross-member may be releasably securable to the inner surface of each side wall. To this end the cross-member and each longitudinal side wall may include cooperating coupling elements which provide for a snap fit therebetween. Apertures may be provided in the transverse wall, the apertures being spaced apart therealong in the longitudinal direction.

In one embodiment each of the side walls may comprise inner and outer skin elements which are spaced apart and interconnected by a plurality of webs which extend between the inner and outer skin. In this embodiment formations may be provided on the inner surfaces of the inner and outer skin elements the formations being arranged in spaced apart fashion along the skin elements so as to be capable for forming a throat section of a coupling member. By this arrangement the side walls can be cut or otherwise separated along the length thereof so as to provide a coupling element at the cut or separated end. The formations may be arranged in oppositely facing groups along the length of the skin elements.

The connector may be in the form of a panel having longitudinally extending side edges extending between opposed ends. The coupling elements may be in the form of laterally extending flanges in the region of the side edges each flange having a head portion which is received within the channel on the component in snap fit fashion. In one form two such flanges are provided, one at side edge region of the panel. In another form four such flanges are provided, two at each side edge region, the flanges at each side edge region extending laterally in opposite directions.

According to another aspect of the present invention there is provided a building component for a structure, the building component including a component body which includes two spaced apart and generally parallel interconnected side walls having opposed ends and opposed longitudinally extending sides, the building component being adapted for joining to another building component or to a connector for joining the building component to another building component, the building component further including coupling elements disposed at said opposed longitudinally extending sides of the sidewalls which cooperate for securement of the component to the other building component or connector, wherein each of the side walls comprises inner and outer skin elements which are spaced apart and interconnected by a plurality of webs which extend between the inner and outer skin.

The building component may include a male coupling element at one side of the side wall and a female coupling element at the other side.

BRIEF DESCRIPTION OF THE DRAWINGS

In order to enable a clearer understanding of the invention drawings illustrating example embodiments are attached and in those drawings.

DETAILED DESCRIPTION OF PREFERRED EMBODIMENTS

Figure 1:
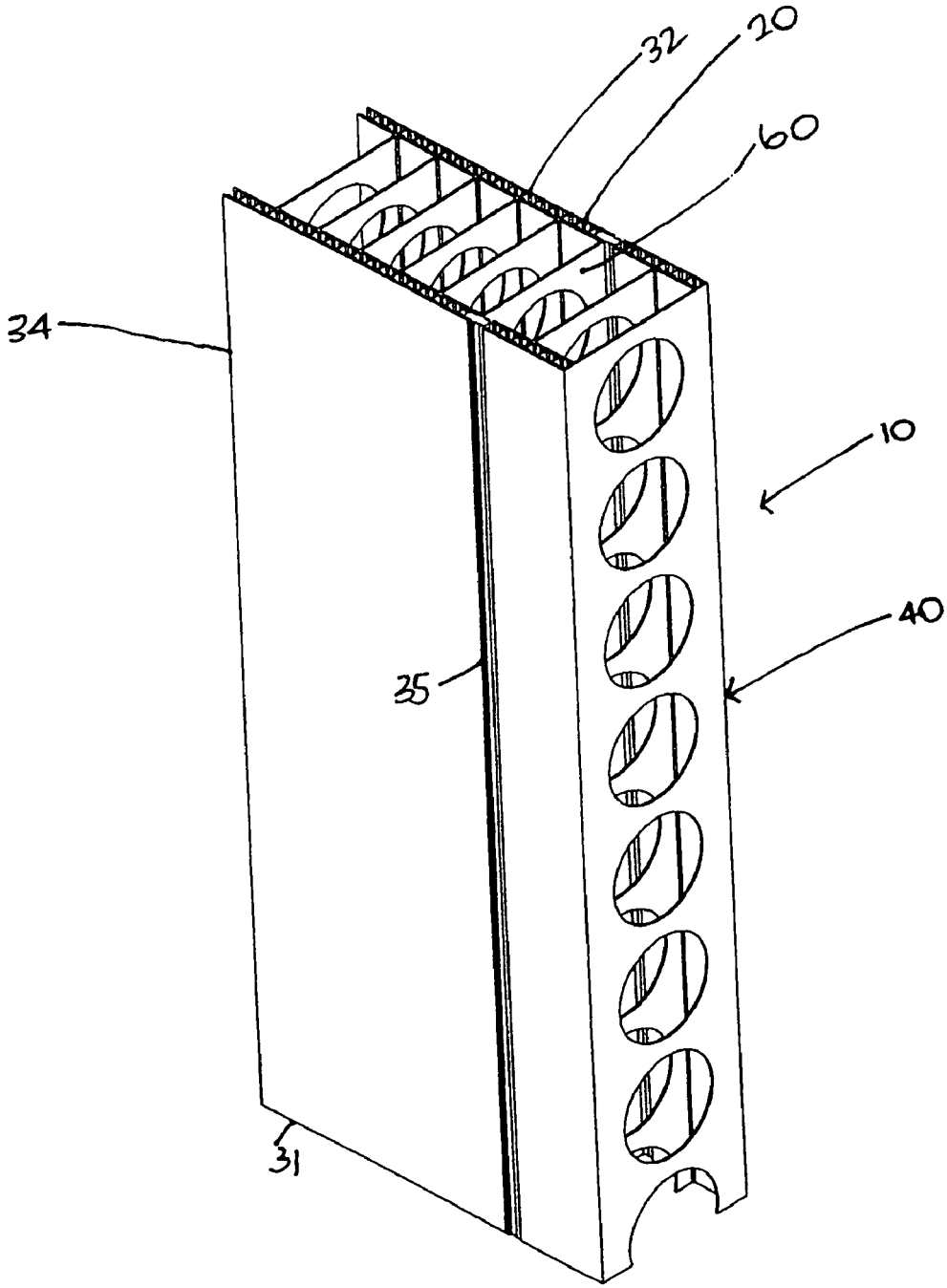
FIG. 1 is an isometric view of building components according to one embodiment of the present invention.
Figure 2:
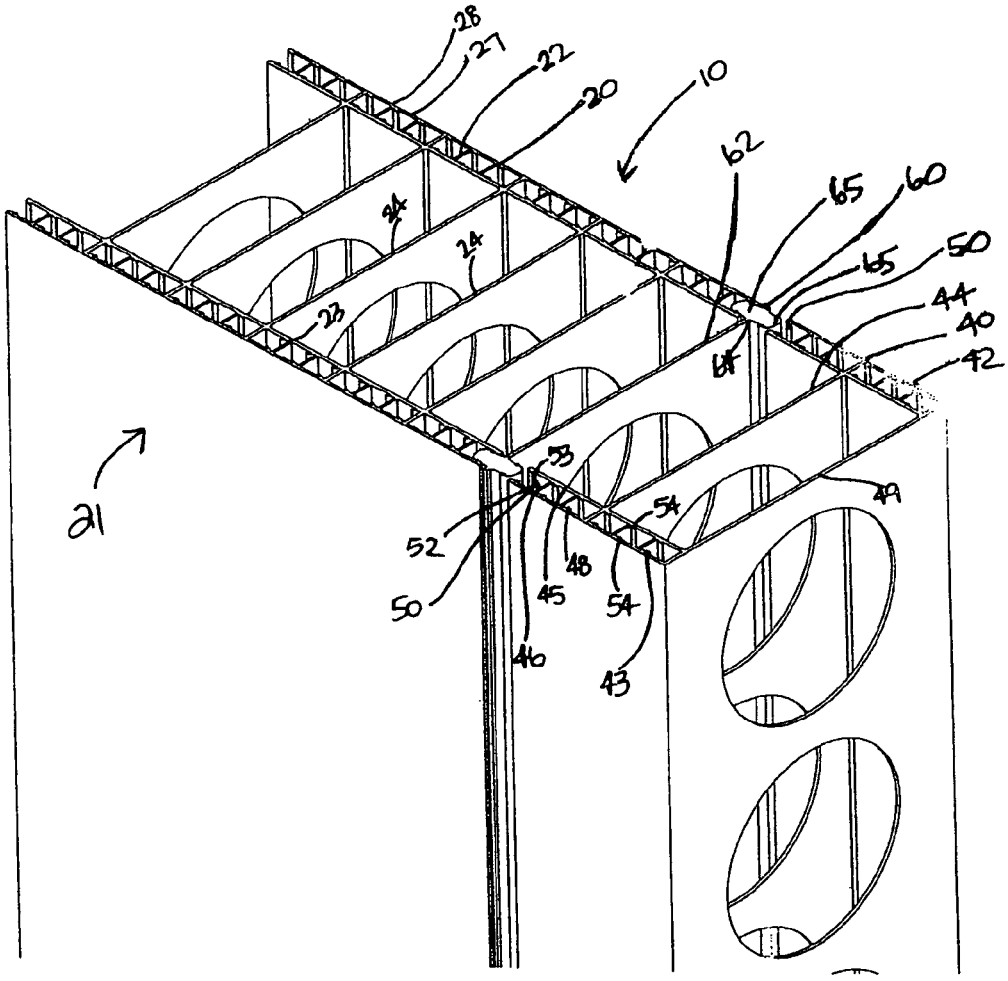
FIG. 2 is a detail of the components shown in FIG. 1.
Figure 3:
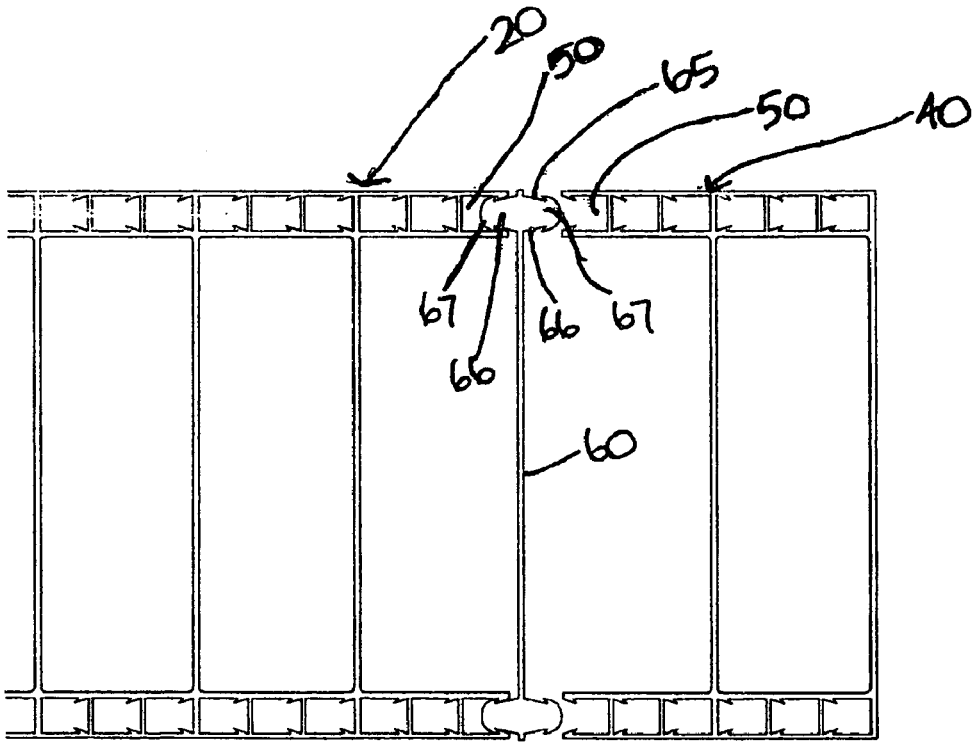
FIG. 3 is a plan view of the building components shown in FIGS. 1 and 2.
Figure 4:
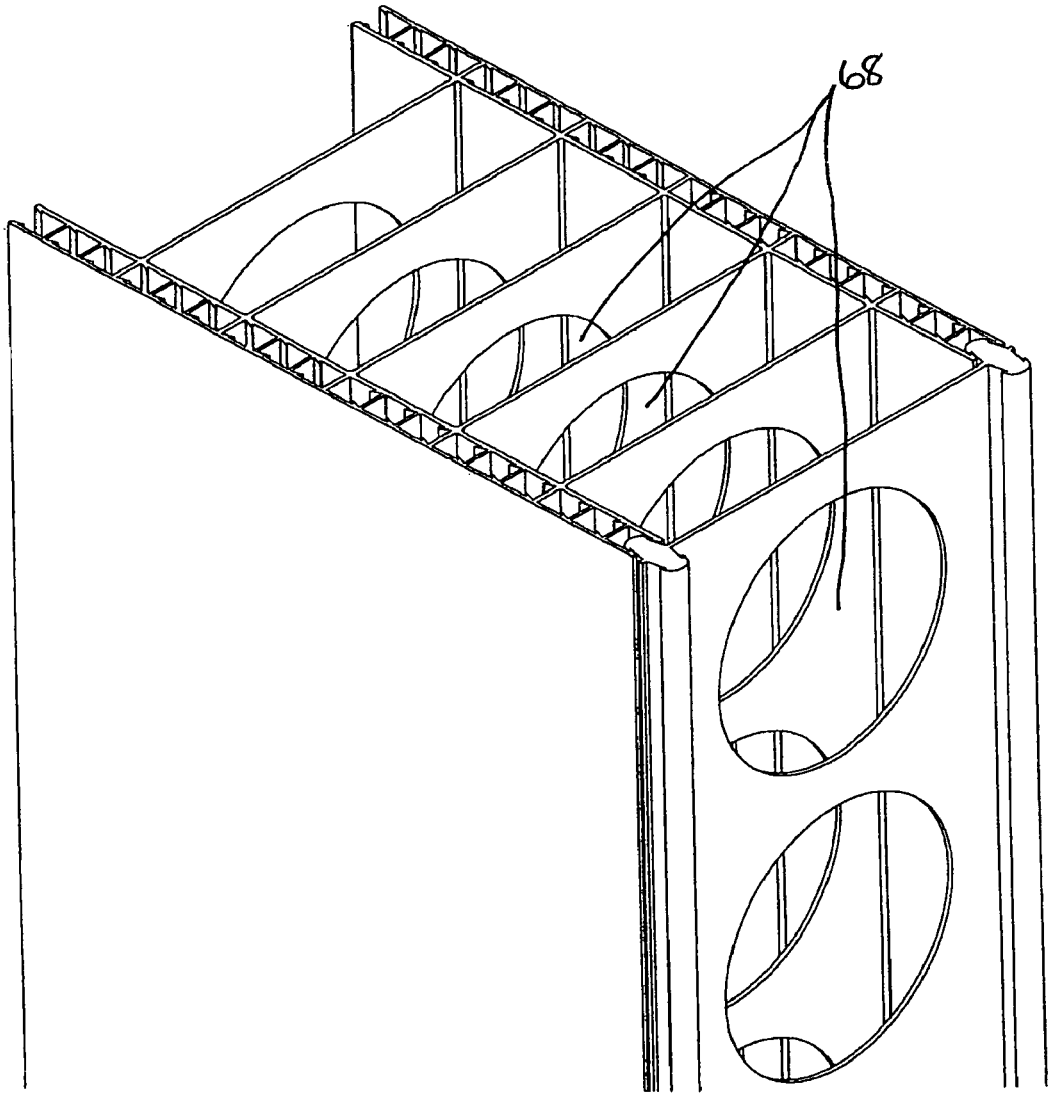
FIG. 4 is a further isometric view of components of the type shown in FIGS. 1 to 3.
Figure 5:
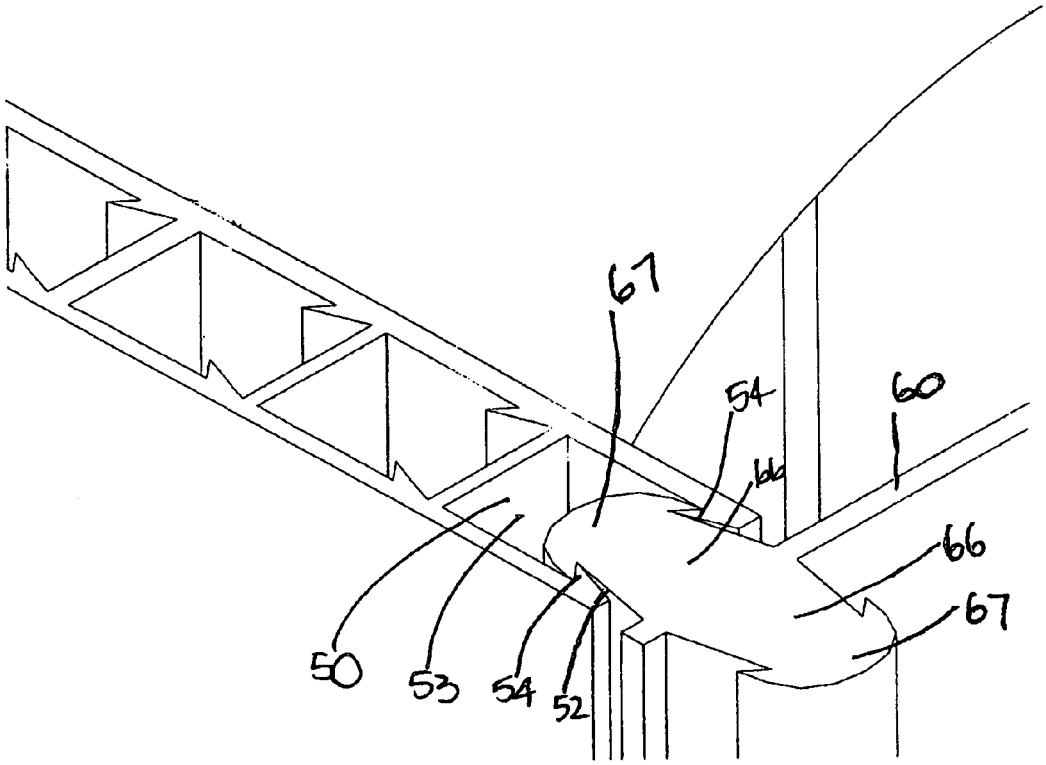
FIG. 5 is a detail of part of the components shown in FIG. 4.

Referring to FIG. 1 there is shown an assembly of building components according to one embodiment of the present invention. The assembly 10 comprises a building component 20 and an end component 40 cooperatively attached together by connector element 60. Each of the components may be formed from plastics materials such as thermoplastics such as polyvinyl chloride for example and manufactured as an extrusion or by any other suitable manufacturing process.

Building component 20 comprises a component body 21 having two spaced apart generally parallel side walls 22 and 23 with a plurality of cross walls 24 extending therebetween. Each side wall 22 and 23 comprises an inner skin 26 and an outer skin 27 with a plurality of spaced apart webs 28 therebetween. The component body 21 comprises opposed ends 31 and 32 and opposed longitudinally extending sides 34 and 35.

Building component 40 is similar in structure to component 20 in that it comprises longitudinally extending side walls 42 and 43, cross walls 44 with each side wall comprising an inner and outer skin 45 and 46 interconnected by webs 48. Building component 40 also includes an end wall 49 at one of the sides of the component body.

The assembly further includes the connector element 60 which operatively secures the building components 20, 40 together. The connector element 60 includes a main panel 62 which extends longitudinally of the components when fitted, the panel having opposed longitudinally extending edge portions 63 and 64. Spaced apart apertures 68 are formed in cross walls 24, 44 and panel 62.

The building components 20 and 40 and connector element 60 are provided with cooperating coupling elements which provide for snap fit engagement between the parts being connected. In this regard components 20 and 40 have channels 50 at each longitudinal side of the component body. Each channel 50 has a mouth 52 and formations providing for a throat 53 formed by barbed formations 54. Component 20 has channels 50 at both longitudinal sides whereas component 40 has channels 50 at the longitudinal side opposite to end wall 49. Pairs of formations are spaced along the components so that component 20 can be cut to a desired length with a coupling element being adapted for use at the cut length.

The connector element 60 comprises tongues 65 in the region of each edge portion. The tongues 65 are in the form of longitudinally extending flanges 66 having head sections 67. The arrangement is such that the heads 67 can snap fit into the channels 50 on the building components 20 and 40. Rib 79 is disposed on an outer side of the edge portion 63 and 64 so that the component edges abut the rib, so as to hold the components snugly against one another.

Figure 6:
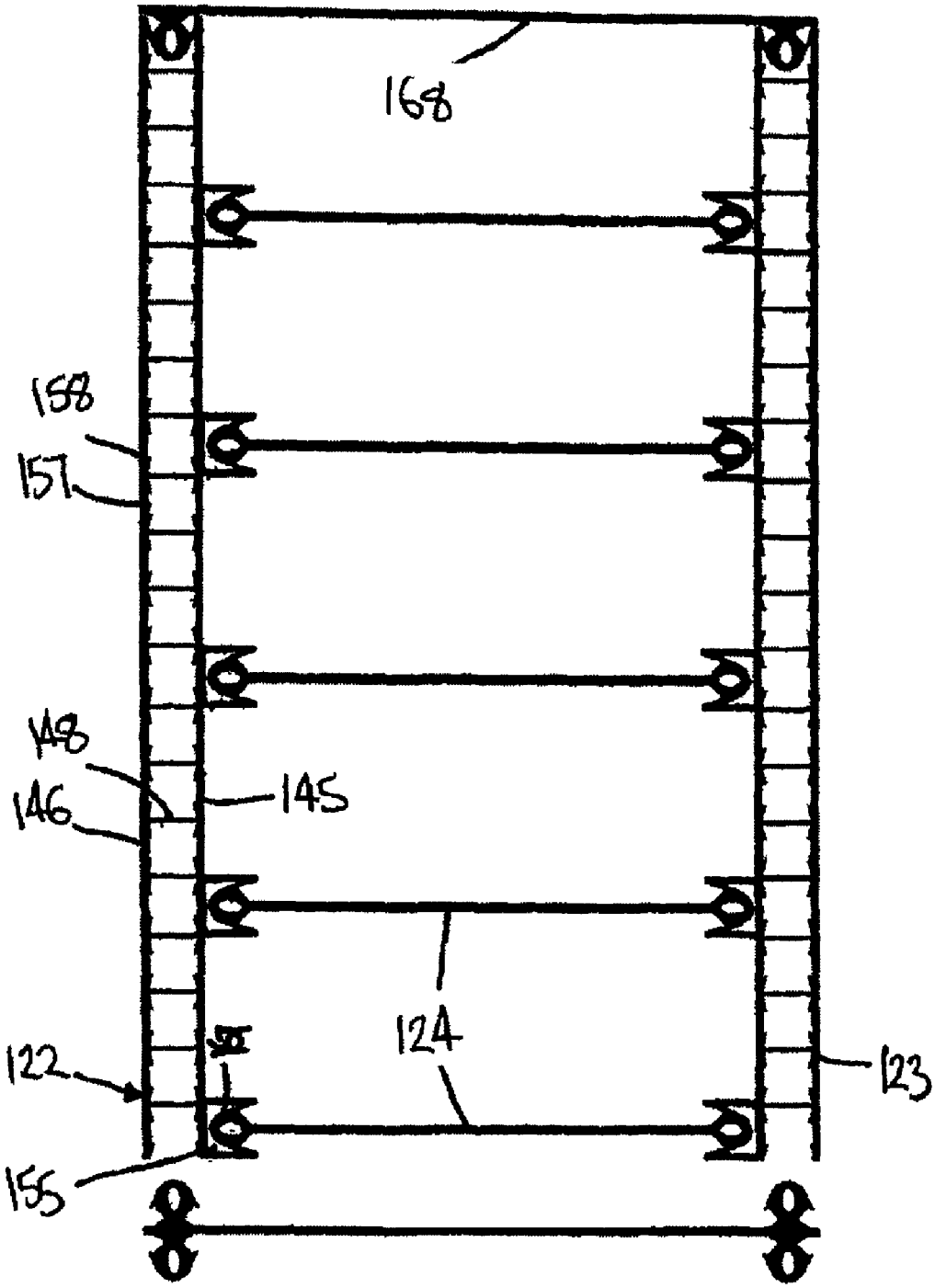
FIG. 6 is a plan view of building components according to another embodiment of the invention.

FIG. 6 illustrates a further embodiment of building component which is formed from a number of separate elements which can be assembled together. In this embodiment the assembly comprises two side wall members 122 and 123 which are interconnectible by a plurality of spaced apart cross members 124. Each side wall member 122 and 123 comprises an inner and outer skin 145 and 146 interconnected by webs 148. The side wall members 122 and 123 are connected together by cross members 124 which are secured to the inner skin of each side wall member. To this end the side edges of the cross-members 124 have head sections 167 which are receivable within channels 155 on the inner surfaces of the inner skins. The channels 155 have a throat section formed by barbed formations 154 on the inner surfaces of the inner and outer skins. The formations are arranged in groups which face in opposite directions, so that the component 120 may be cut to a desired length with a coupling element being adapted for use at the cut length. Typical oppositely facing groups of formations are illustrated at 157 and 158 in FIGS. 6 and 7.

Connector element 160 is of the same configuration as that described earlier, except that the head section 167 includes a void 169. End plate 168 is similar to the element 160 except that it only has one set of flanges.

Figure 7:
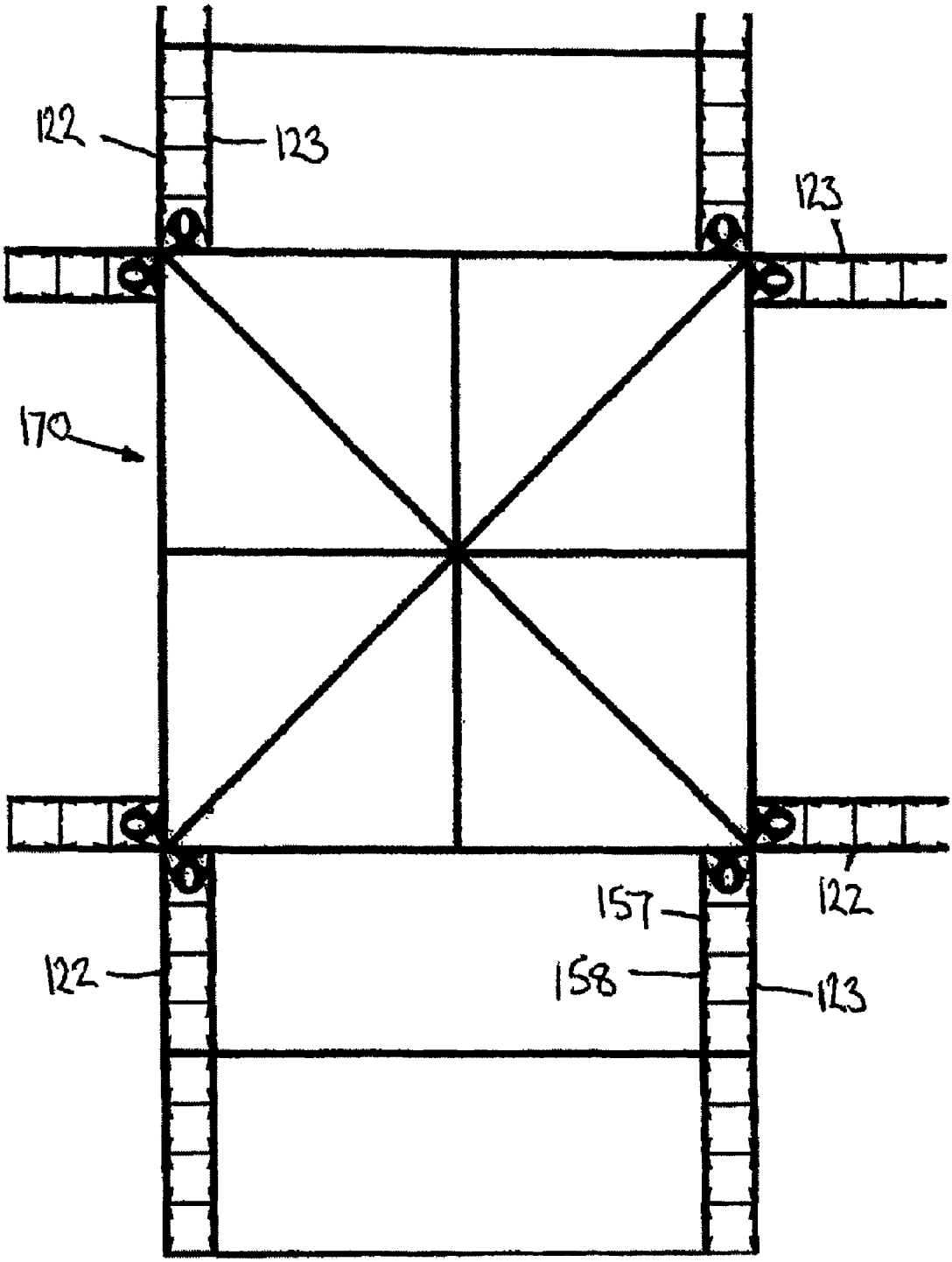
FIG. 7 is a plan view of a further building component according to a preferred embodiment the invention.

FIG. 7 illustrates a corner element 170 which can connect components together at an angle relative to one another.

Figure 8:
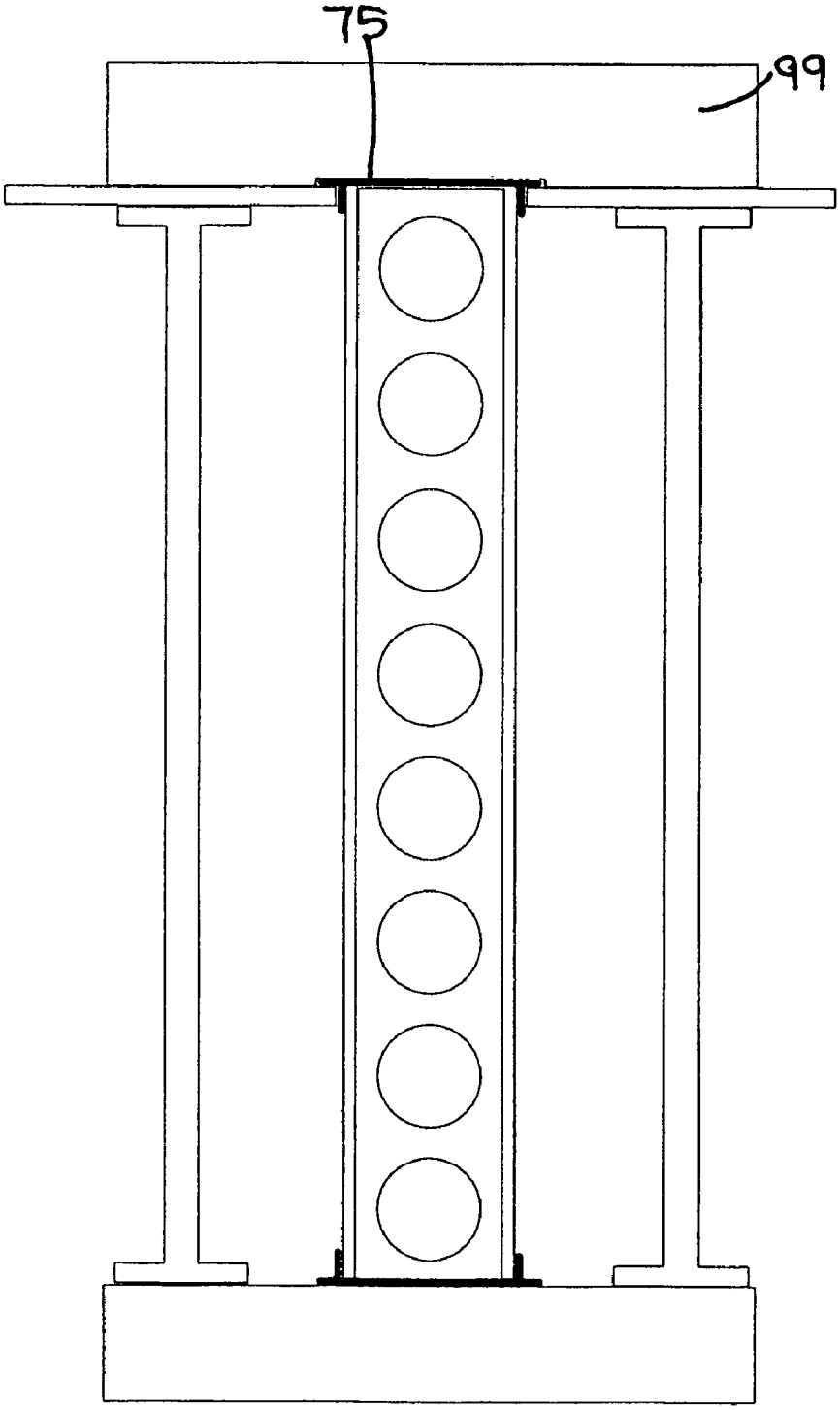
FIG. 8 is a section view of a building component in accordance with a preferred embodiment of the present invention, the building component shown with a cap to inhibit leakage or overflow of a filler material from a top of the building component onto a face of the component.
Figure 9:
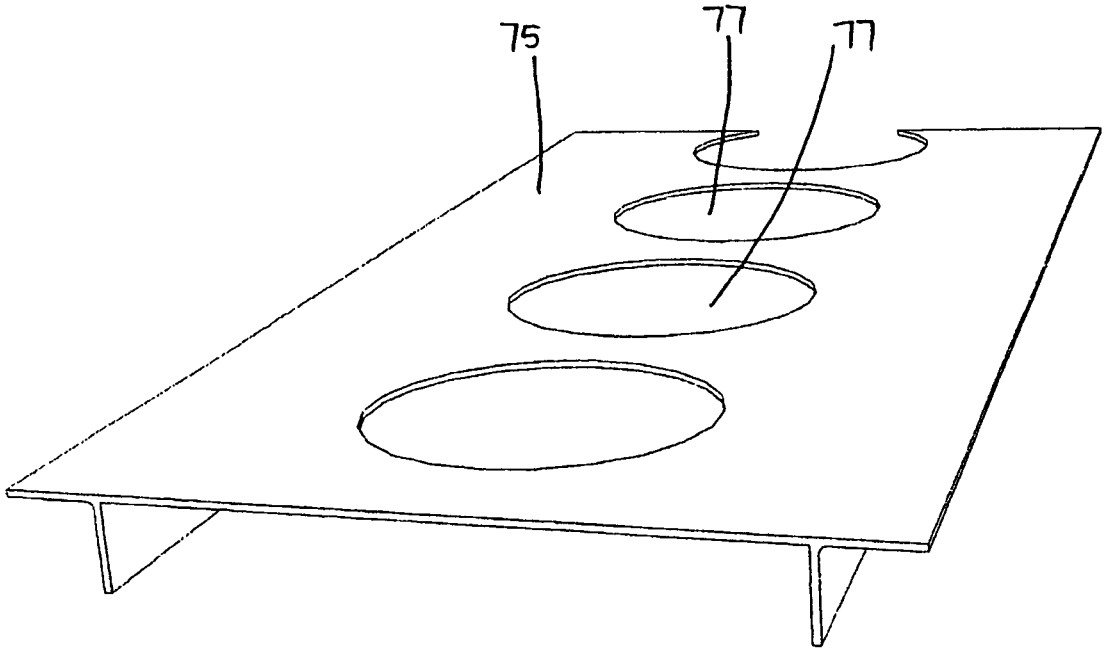
FIG. 9 is an isometric view of the cap shown in FIG. 8.

FIG. 9 shows a cap 75 which is installed as shown in FIG. 8 at top and bottom of the building component 20 or 120 so that, when concrete or other filler, which may include mud, sludge, sand, or the like, is poured into the component 20, 120 or 220, or 320, the concrete or other filler is inhibited from issuing and spilling onto the outside finished face of the side wall members 22 and 23. The cap has apertures 77 which allow concrete to be poured through and to mount reinforcing to key the component 20 to a floorslab 99 above and to receive key elements from below.

Figure 10:
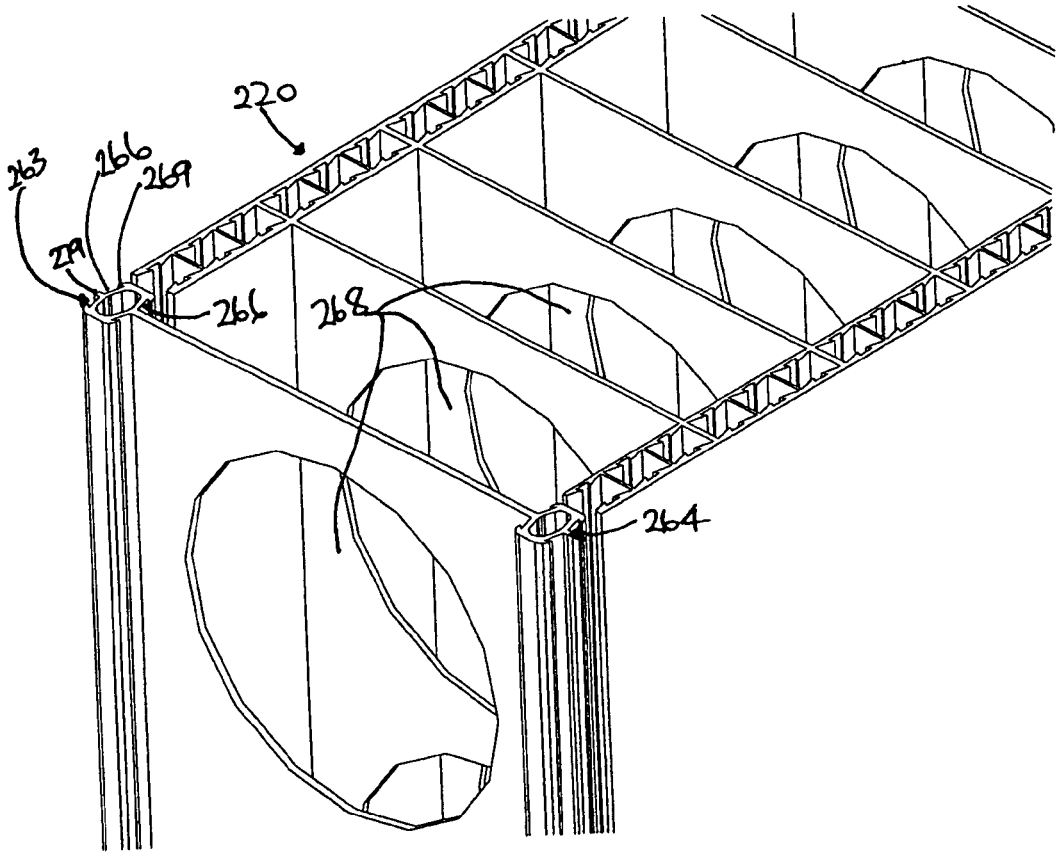
FIG. 10 is an isometric view of a building component in accordance with another example embodiment of the present invention, shown with a connector for joining the building component to another building component.
Figure 11:
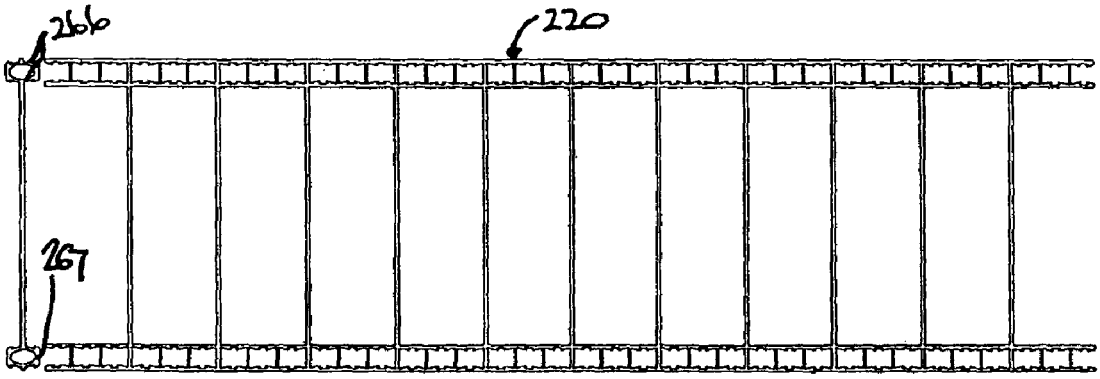
FIG. 11 is a plan view of the building component and connector shown in FIG. 10.

FIGS. 10 and 11 show another example embodiment of building component 220 wherein the connector element 260 has two flanges spaced on either side of void 269. Rib 279 is disposed on an outer side of the edge portions 263 and 264 so that components 220 abut the rib 279 when assembled, to facilitate snug or tight retention of the components 220.

Figure 12:
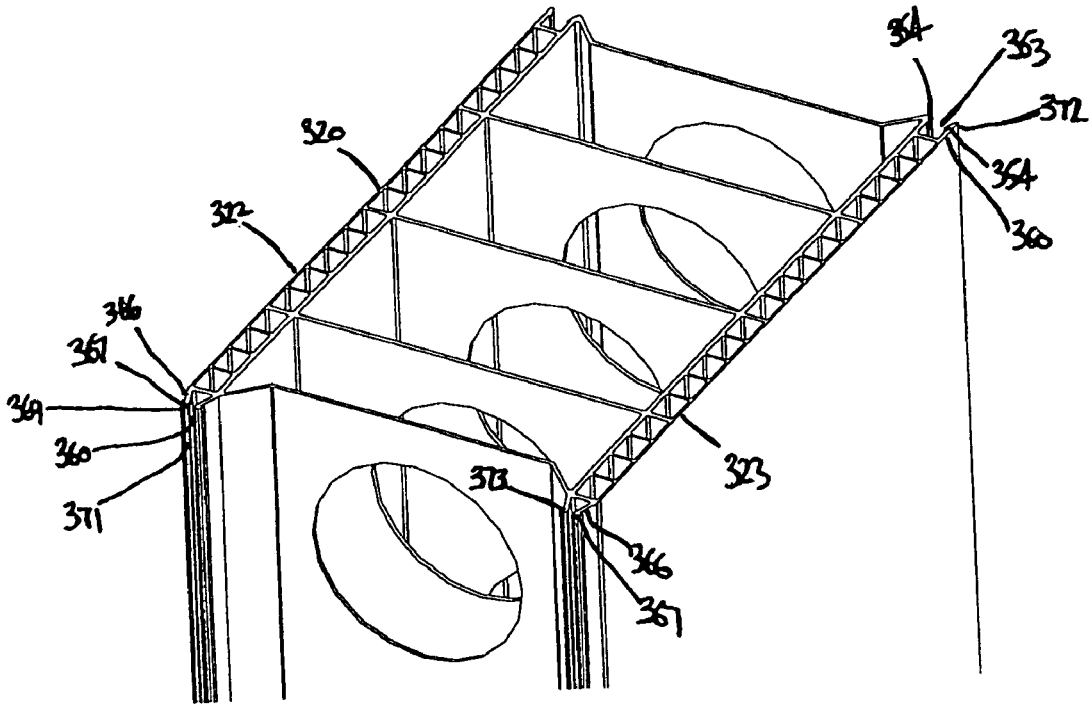
FIG. 12 is an isometric view of a building component in accordance with yet another example embodiment of the present invention.

FIG. 12 shows an example embodiment of another aspect of the present invention, wherein the component 320 includes cooperating coupling elements 360 integral with the sides of the sidewalls 322 and 323. A male coupling element 371 and a female coupling element 372 are provided. The male coupling element 371 includes a pair of flanges 366 spaced apart across a void 369 and a head section 367 is in the form of ribs 373. The flanges 367 are configured to insert into channel 350, through throat 353 and are retained by barbed formations 354. The engagement of the flanges 367 with the barbed formations 354 is a snap engagement.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

Finally, it is to be understood that various alterations, modifications and/or additions may be incorporated into the various constructions and arrangements of parts without departing from the spirit or ambit of the invention.

The invention claimed is:

1. A building component for a structure, the building component including:

a component body which includes two spaced apart and generally parallel interconnected side walls having opposed ends and opposed longitudinally extending sides, the building component being adapted to join with a second building component or to a connector for joining the building component to the second building component, the building component further including a plurality of coupling elements arranged integrally on the sidewalls, and at spaced-apart intervals along a length of the side walls, between the opposed longitudinally extending sides of the side walls, and arranged such that in use the side walls can be cut or otherwise separated along the length thereof so as to thereby expose an integral coupling element at the cut or separated end in a manner whereby the coupling element is thereby adapted to cooperate with a mating coupling element on a connector for securement of the building component to a second building component or connector.

2. The building component and connector in accordance with claim 1 wherein the coupling elements cooperate to provide for a snap fit engagement between the building component and the connector.

3. A building component for a structure, the building component including:

a component body which includes two spaced apart and generally parallel interconnected side walls having opposed ends and opposed longitudinally extending sides, the building component being adapted to join with a second building component or to a connector for joining the building component to the second building component, the building component further including a plurality of coupling elements arranged at spaced-apart intervals along a length of the side walls between the opposing ends of the side walls and arranged such that in use the side walls can be cut or otherwise separated along the length thereof so as to provide a coupling element at the cut or separated end which is adapted to cooperate with a mating coupling element on said connector for securement of the component to the second building component or connector, wherein the cooperating coupling elements include a cavity on one part and a tongue on the other part, the tongue being receivable within an interior of the cavity in a snap fit engagement, wherein the cavity extends along the longitudinal side edge of the component to form a channel between the opposed ends.

4. The building component in accordance with claim 1 wherein the cooperating coupling elements include a cavity on one part and a tongue on the other part, the tongue being receivable within an interior of the cavity in a snap fit engagement.

5. The building component in accordance with claim 3 wherein the coupling element associated with the connector extends longitudinally along the longitudinal side from one of the ends to the other.

6. The building component in accordance with claim 3 wherein the cavity includes a mouth opening into the cavity interior and a throat section through which the tongue passes in a snap fit fashion.

7. The building component in accordance with claim 3 wherein the building component further includes at least one cross-member extending between the side walls.

8. The building component in accordance with claim 7 wherein the one or each cross-member is in the form of a transverse wall which is secured to or integral with an inner surface of each side wall.

9. The building component in accordance with claim 8 wherein the one or each cross-member is releasably securable to the inner surface of each side wall.

10. The building component in accordance with claim 9 wherein the one or each cross-member and each longitudinal side wall includes cooperating coupling elements which provide for a snap fit therebetween.

11. The building component in accordance with claim 8 wherein apertures are provided in the or each transverse wall, the apertures being spaced apart therealong in the longitudinal direction.

12. The building component in accordance with claim 3 wherein each of the side walls comprises inner and outer skin elements which are spaced apart and interconnected by a plurality of webs which extend between the inner and outer skin.

13. The building component in accordance with claim 12 wherein formations may be provided on the inner surfaces of the inner and outer skin elements the formations being arranged in spaced apart fashion along the skin elements so as to be capable for forming a throat section of a coupling member so that in use the side walls can be cut or otherwise separated along the length thereof so as to provide a coupling element at the cut or separated end.

14. The building component in accordance with claim 13 wherein the formations may be arranged in oppositely facing groups along the length of the skin elements.

15. The building component in accordance with claim 3 wherein the building component is adapted to cooperate with a connector which is in the form of a second panel having longitudinally extending side edges extending between opposed ends.

16. The building component in accordance with claim 15 wherein the coupling element of the connector is in the form of laterally extending flanges in the region of the side edges, each flange having a head portion which is received within a channel on the building component in snap fit fashion.

17. The building component in accordance with claim 16 wherein two such flanges are provided, one at a side edge region of the panel.

18. The building component in accordance with claim 16 wherein four such flanges are provided, two at each side edge region, the flanges at each side edge region extending laterally in opposite directions.

19. A building component for a structure, the building component including:

a component body which includes two spaced apart and generally parallel interconnected side wall members having opposed ends and opposed longitudinally extending sides, each side wall member comprising inner and outer surfaces, the building component being adapted to join with a second building component or to a connector for joining the building component to the second building component, the building component further including a plurality of coupling elements arranged integrally on the sidewalls. and at spaced-apart intervals along a length of each of the side wall members, between the inner and outer surfaces of the side wall members, and arranged such that in use each side wall member can be cut or otherwise separated along the length of the member so as to thereby expose an integral coupling element at the end formed by the cut or separation in a manner whereby the coupling element is thereby adapted to cooperate with a coupling element on a connector for securement of the building component to a second building component or connector.

* * * * *